US010119371B2

(12) United States Patent
Kristoffersen et al.

(10) Patent No.: US 10,119,371 B2
(45) Date of Patent: Nov. 6, 2018

(54) FLEXIBLE LINE INSTALLATION AND REMOVAL

(71) Applicant: STATOIL PETROLEUM AS, Stavanger (NO)

(72) Inventors: Steinar Kristoffersen, Kolsås (NO); Guillaume Gravey, Oslo (NO); Øyvind Haug, Lillestrøm (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/319,677

(22) PCT Filed: Jun. 18, 2014

(86) PCT No.: PCT/EP2014/062899
§ 371 (c)(1),
(2) Date: Dec. 16, 2016

(87) PCT Pub. No.: WO2015/192899
PCT Pub. Date: Dec. 23, 2015

(65) Prior Publication Data

US 2017/0122079 A1 May 4, 2017

(51) Int. Cl.
*E21B 19/22* (2006.01)
*E21B 17/01* (2006.01)
(Continued)

(52) U.S. Cl.
CPC ..... *E21B 43/0135* (2013.01); *E21B 17/012* (2013.01); *E21B 17/015* (2013.01);
(Continued)

(58) Field of Classification Search
CPC .. E21B 43/0135; E21B 17/012; E21B 17/015; E21B 19/004; E21B 19/008; E21B 19/22; E21B 43/0107
See application file for complete search history.

(56) References Cited

U.S. PATENT DOCUMENTS 5,553,976 A 9/1996 Korsgaard
7,927,041 B2 4/2011 Bonnemaire et al.
(Continued)

FOREIGN PATENT DOCUMENTS

RU 2147334 C1 4/2000
RU 2328589 C2 7/2008
(Continued)

*Primary Examiner* — Matthew R Buck
*Assistant Examiner* — Douglas S Wood
(74) *Attorney, Agent, or Firm* — Birch, Stewart, Kolasch & Birch, LLP

(57) ABSTRACT

A method of removing a flexible line deployed between an offshore platform and a subsea structure, where the platform has a landing deck on which the flexible line is installed, the landing deck facing away from the platform towards an installation side. The method comprises: decoupling a topside end of the flexible line from the landing deck; lowering the topside end from the landing deck to the sea bed using a platform mounted winch, and detaching the winch from the topside end; moving the platform in a direction away from the installation side and positioning an installation vessel on the installation side; lowering a recovery line from the installation vessel and attaching an end of the recovery line to the topside or subsea end of the riser; raising the attached topside or subsea end onto the installation vessel from the seabed using the recovery line; and recovering the flexible line onto the installation vessel, whereupon the platform can be moved back to an operating position.

22 Claims, 13 Drawing Sheets

(51) Int. Cl.
*E21B 43/01* (2006.01)
*E21B 43/013* (2006.01)
*E21B 19/00* (2006.01)

(52) U.S. Cl.
CPC ..... *E21B 19/004* (2013.01); *E21B 19/008* (2013.01); *E21B 19/22* (2013.01); *E21B 43/0107* (2013.01)

(56) References Cited

U.S. PATENT DOCUMENTS

| | | | | |
|---|---|---|---|---|
| 8,007,203 | B2 | 8/2011 | Espinasse et al. | |
| 8,142,108 | B2 * | 3/2012 | Pollack | E21B 43/0107 166/367 |
| 2011/0061582 | A1 | 3/2011 | Braud et al. | |
| 2014/0338919 | A1 | 11/2014 | Pionetti | |

FOREIGN PATENT DOCUMENTS

| | | | | |
|---|---|---|---|---|
| RU | 2487044 | C2 | 7/2013 | |
| WO | WO 2004/035375 | A1 | 4/2004 | |
| WO | WO 2011/099869 | A2 | 8/2011 | |
| WO | WO 2011099869 | A2 * | 8/2011 | E21B 17/015 |
| WO | WO-2011099869 | A2 * | 8/2011 | E21B 17/015 |
| WO | WO 2013/079857 | A1 | 6/2013 | |

* cited by examiner

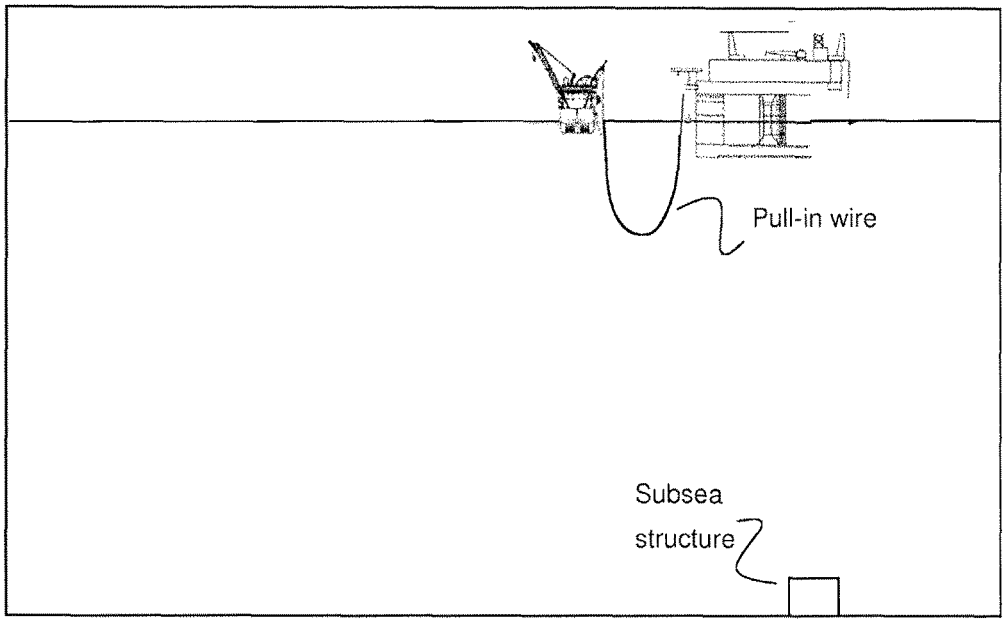
Figure 1 - PRIOR ART
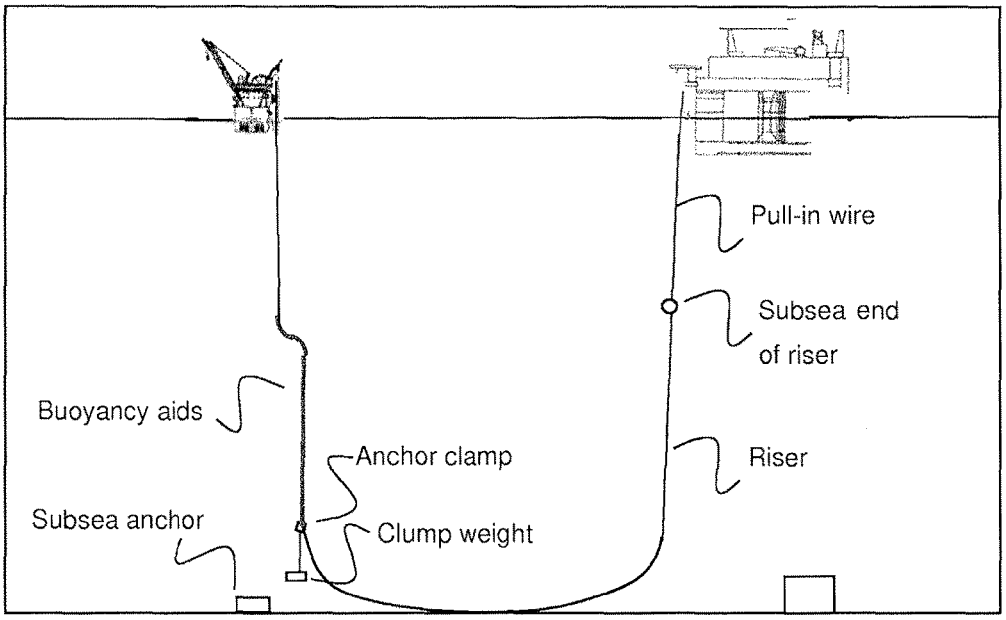
Figure 2 - PRIOR ART

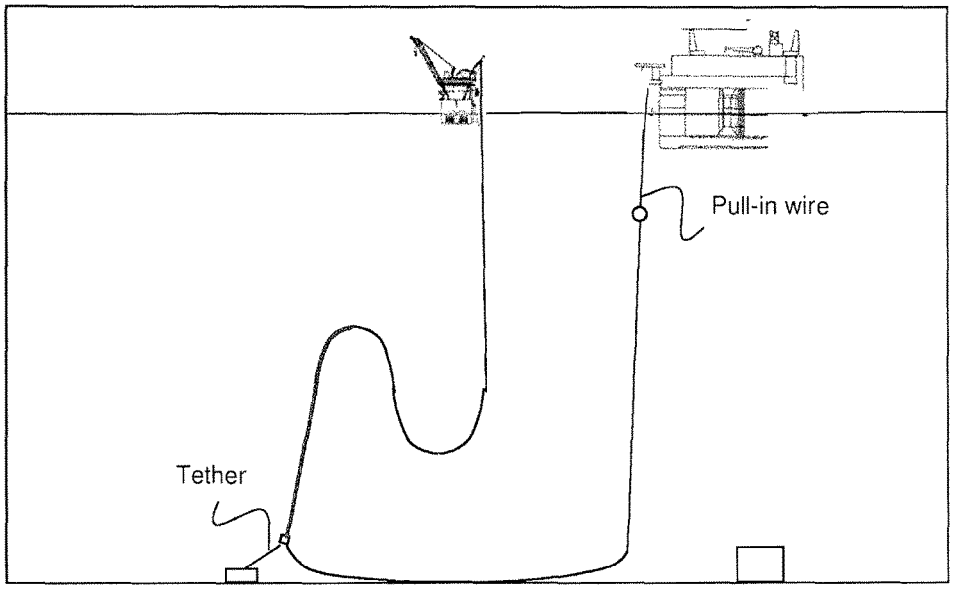
Figure 3 - PRIOR ART
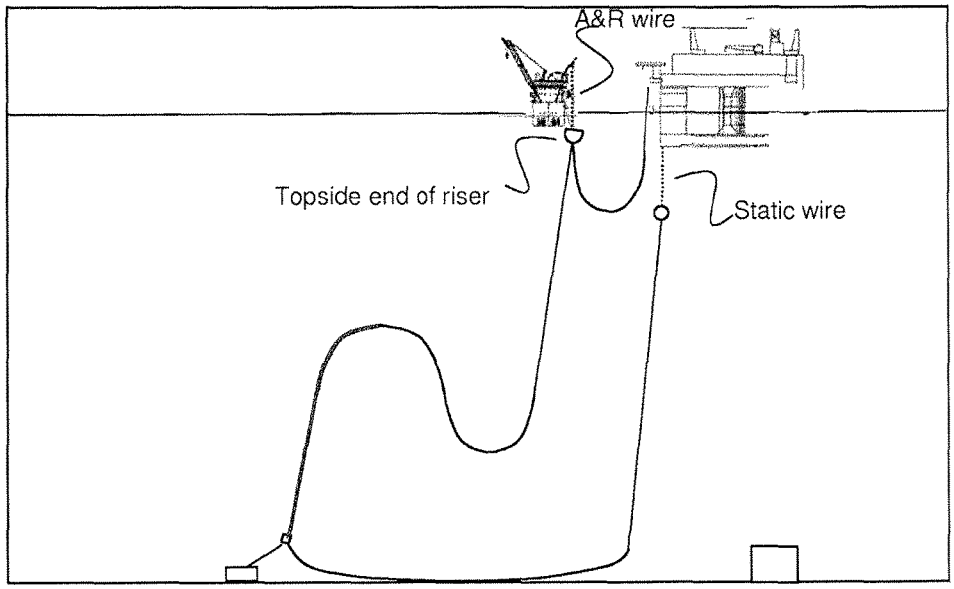
Figure 4 - PRIOR ART

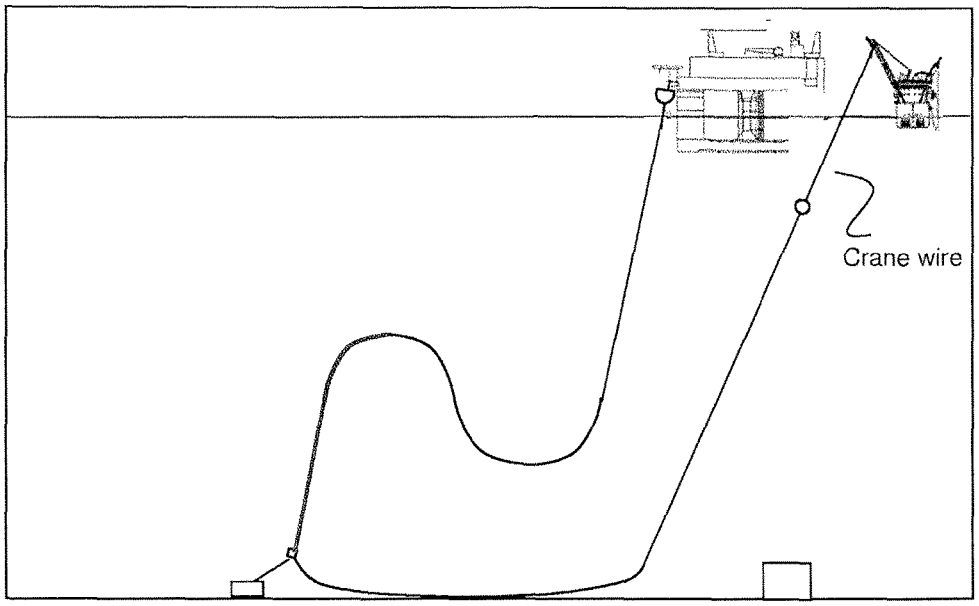
Figure 5 - PRIOR ART
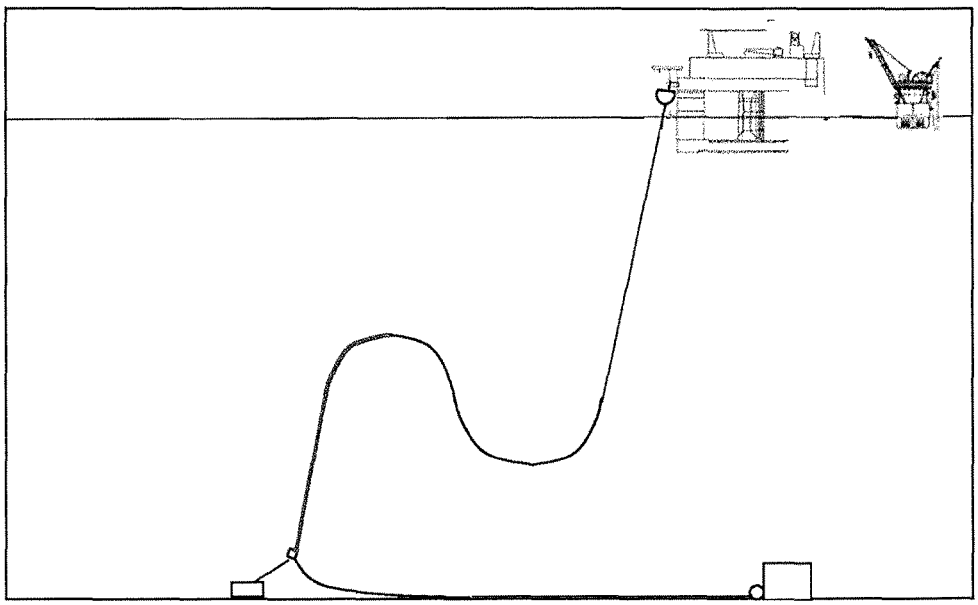
Figure 6 - PRIOR ART

FLEXIBLE LINE INSTALLATION AND REMOVAL

TECHNICAL FIELD

The present invention relates to the installation and removal of flexible lines between an offshore platform or vessel and a subsea structure. The invention is applicable, for example, to the installation and removal of flexible risers, power cables, umbilicals and the like.

BACKGROUND

In the context of offshore hydrocarbon production, a riser is a tubular conduit that extends from a subsea structure to a production platform, for the purpose of conveying produced hydrocarbons from the well to the platform. The subsea structure may be a "christmas tree", riser base, Blowout Preventer (BOP), or some other structure.

Risers are configured in order to allow for movements of the platform relative to the subsea structure in both a horizontal and a vertical direction, for example to facilitate drilling and well maintenance operations to be performed from the platform and to accommodate the effects of ocean currents, wind and waves on the risers and platform. Riser configurations include a "free hanging" configuration, a Reverse Pliant Wave configuration, a Pliant Wave configuration, a lazy S configuration, and other suitable configurations.

Offshore hydrocarbon production platforms may be fixed or floating. In addition to collecting produced hydrocarbons, floating production units (FPUs, a term that encompasses floating offshore hydrocarbon production platforms such as semisubmersible floating production systems; ship-shaped floating production, storage and offloading systems; tension leg platforms; and spar platforms) may also be used as drilling platforms to drill multiple new subsea wells. The subsea wells may be located substantially directly underneath the FPU, with the risers connecting the FPU to the well, and the drilling apparatus may extend downwards from the centre of the FPU. It may therefore be necessary to move the FPU in order to allow new wells to be drilled and/or to allow existing wells to be maintained. The connection between the platform and the subsea structures via the risers can be maintained during drilling and during the movement of the platform, thus allowing hydrocarbon production and collection to continue. By way of example, an FPU may be moveable horizontally by a distance in the region of 80 meters in any direction relative to a central position above the subsea wells. Movement is achieved by pulling in and playing out mooring lines attached to the four corners of the FPU.

For riser removal and installation operations on platforms where the risers are exposed/hanging on the platform side, the normal methodology involves the use of an installation vessel (IV) in addition to the platform itself. The IV is equipped with industry-standard laying spread (normally Vertical Laying System—VLS) and reels/carousels/baskets for storage of risers. The IV can install the riser from both directions, i.e. either the subsea or the topside end of the riser may be installed first (subject for example to already in-place riser configuration, auxiliary equipment size, packing constraints etc.).

FIGS. 1 to 6 illustrate schematically various stages in the conventional riser installation process in the case of a Floating Production Unit (FPU) where the riser is being installed to achieve a Pliant Wave configuration. Very generally, the process involves the following steps:

(1) An end of a pull-in wire, suspended from the platform, is transferred from the platform to the installation vessel (FIG. 1).

(2) The transferred end of the pull-in wire is attached to the bottom of the riser that is being constructed at the installation vessel, such that the pull-in wire is now suspended between the platform and the riser. This bottom end of the riser will subsequently be attached to the subsea structure and so is referred to hereinafter as the "subsea" end of the riser.

(3) The riser is fed into the water from the installation vessel and an increasing length of the riser is laid along the seabed. During this stage, the installation vessel steps away from the platform.

(4) At this stage, the riser has adopted a flat-bottomed U-shaped configuration in the water (FIG. 2). At some intermediate point in this procedure clump weight(s) and anchor clamp(s) are installed at predetermined points on the riser and buoyancy modules are installed around the riser, over a certain length.

(5) As the riser is deployed further the clump weight comes to rest on the seabed. The riser is then tethered to a preinstalled subsea anchor by attaching the anchor clamp to the subsea anchor. The installation vessel then moves back towards the platform, deploying the riser in the Pliant Wave configuration (FIG. 3).

(6) The subsea end of the riser is transferred from the pull-in wire to a static wire depending from the platform (FIG. 4).

(7) The pull-in wire is transferred to the installation vessel and a second end of the riser, which will subsequently be attached to the platform and so is referred to hereinafter as the "topside" end of the riser, is attached to the pull-in wire. The topside end of the riser is also attached to an abandonment and recovery (A&R) wire depending from the installation vessel. The topside end of the riser is lowered from the installation vessel using the A&R wire until the pull-in wire is taking the weight of the riser. The A&R wire is then disconnected from the topside end of the riser, and the topside end of the riser is pulled in to the platform using the pull-in wire and is then attached to the platform at the platform's riser balcony (FIGS. 4 and 5).

(8) The installation vessel moves to the side of the platform opposite the riser balcony, and a crane wire is lowered from the installation vessel and connected to the subsea end of the riser, typically using an ROV (FIG. 5).

(9) The subsea end of the riser is disconnected from the static line depending from the platform and is lowered to the seabed in the vicinity of a subsea structure using the crane wire from the installation vessel. The subsea end of the riser may be connected to the subsea structure using an appropriate tie-in tool and/or divers and/or an ROV (FIG. 6).

WO2011/099869 describes a method of installing a riser, similar to the method described above.

When implementing riser installation using these known procedures, it is necessary for the installation vessel to move close in to the platform's riser balcony (typically 20-40 m away) during the transfer of the subsea end of the riser and the topside end of the riser to the platform (FIG. 1), in order to maintain the integrity of the guide tube loads, maintain the bending radius of the riser, and prevent any contact between the riser and the port in the installation vessel through which it is lowered. The fact that the installation vessel must move so close to the platform is a significant disadvantage due to the risk of collision with the risers hanging from the riser balcony. Indeed, many operators/regulators define an exclusion zone in the area adjacent to the riser balcony, e.g. typically extending up to 200 m away from the riser balcony. If vessels do need to enter the exclusion zone, production and other operations must be ceased. Any cessation of production represents a significant expense.

It will be appreciated that risers may be removed using the reverse of the installation procedure described above (FIGS. 1 to 6) and that similar problems may be encountered.

It is noted that procedures similar to those used to install and remove risers may be used to install and remove other types of flexible lines, such as power cables and umbilicals. As such, the same problem is encountered, i.e. the need for an installation vessel to enter the exclusion zone and consequential shut down of operations.

SUMMARY

It is an object of the present invention to overcome or at least mitigate the problems encountered with known flexible line installation and removal procedures. In particular, it is an object of the invention to allow the removal and installation of a flexible line without requiring a vessel to enter an exclusion zone around a platform, by taking advantage of the ability of the platform to move.

According to a first aspect of the present invention there is provided a method of removing a flexible line deployed between an offshore platform and a subsea structure, where the platform has a landing deck on which the flexible line is installed, the landing deck facing away from the platform towards an installation side. The method comprises: decoupling a topside end of the flexible line from the landing deck; lowering the topside end from the landing deck to the sea bed using a platform mounted winch, and detaching the winch from the topside end; moving the platform in a direction away from the installation side and positioning an installation vessel on the installation side; lowering a recovery line from the installation vessel and attaching an end of the recovery line to the topside or subsea end of the riser; raising the attached topside or subsea end onto the installation vessel from the seabed using the recovery line; and recovering the flexible line onto the installation vessel, whereupon the platform can be moved back to an operating position.

Prior to decoupling the topside end of the flexible line from the landing deck and lowering the topside end from the landing deck, the method may further comprise moving the platform in a direction towards the installation vessel.

The recovery line on the installation vessel may be extended substantially to its maximum extent from the installation vessel towards the platform.

The method may further comprise attaching the end of the recovery line to the topside or subsea end of the riser using a Remotely Operated Vessel, ROV.

The method may further comprise disconnecting the winch from the topside end of the flexible line using an ROV.

After the step of recovering the flexible line onto the installation vessel, the method may further comprise moving the installation vessel in a direction away from the landing deck and relocating the platform to said operating position.

According to a second aspect of the present invention there is provided a method of installing a flexible line between an offshore platform and a subsea structure, where the platform has a landing deck for landing the flexible line, the landing deck facing away from the platform towards an installation side. The method comprises: moving the platform in a direction away from the installation side and positioning the installation vessel on the installation side; lowering a topside or subsea end of the flexible line from the installation vessel; moving the installation vessel away from the platform and moving the platform in a direction towards the installation vessel; and installing the lowered end to a subsea structure or to the landing deck.

Where it is the topside end of the flexible riser that is lowered from the installation vessel, prior to the step of installing the lowered topside end the method may further comprise lowering a line from the platform using a platform mounted winch and attaching an end of the line to the topside end of the riser, and raising the topside end onto the landing deck using the line. Before lowering the topside end of the flexible line from the installation vessel, the method may further comprise lowering a subsea end of the flexible line from the installation vessel using a winch mounted on the installation vessel. After lowering a subsea end of the flexible line from the installation vessel, the method may further comprise disconnecting the winch line from the subsea end of the flexible line and coupling the subsea end to the subsea structure. The method may further comprise pulling the subsea end of the flexible line to the subsea structure using an ROV or a pull in wire depending from the platform. The method may further comprise pulling the subsea end of the flexible line to the subsea structure using a pull in wire depending from the platform. The method may further comprise disconnecting the winch from the subsea end and coupling the subsea end to the subsea structure using an ROV. After moving the platform in a direction away from the installation side and prior to lowering a topside end of the flexible line from the installation vessel, the method may further comprise installing buoyancy aids and/or weights on the flexible line and tethering the flexible line to a subsea anchor. The method may further comprise attaching the end of the pull in line to the topside end of the riser using an ROV.

The flexible line may be a riser for conveying hydrocarbons from a subsea well to an offshore platform, and said landing deck may be a riser balcony.

The flexible line may be deployed between the offshore platform and the subsea structure in a pliant wave configuration.

An exclusion zone may surround the landing deck of the offshore platform, wherein the exclusion zone is defined such that hydrocarbon production must be ceased if a vessel enters the exclusion zone.

The platform may be moored using mooring lines and said step(s) of moving the platform may comprise pulling in and playing out the mooring lines.

Where reference is made above to the use of winches and lines, it will be appreciated that certain steps of the procedures may be carried out using a single winch or line, or using two or more winches or lines. For example, during a single step, e.g. lowering an end of the flexible line, the line may be swapped between winches and lines during the step. Multiple winches and lines may be used simultaneously. The terms "winches" and "lines" are construed to cover related apparatus including, for example, "cranes", "hoists" etc.

BRIEF DESCRIPTION OF THE DRAWINGS

FIGS. 1 to 6 illustrate schematically a prior art procedure for installing a flexible riser between a semi-submersible platform and a subsea structure;

DETAILED DESCRIPTION

In the case of deep water hydrocarbon wells, floating production units (FPUs) are most commonly used as a means of receiving hydrocarbons from the well, storing it if necessary, and delivering it to oil tankers or exporting it through export pipelines. FPUs may be of various types including, for example, semi-submersible platforms, Floating Production Storage and Offloading (FPSO) vessels, tension leg platforms, and spar platforms. As has been described above, flexible risers are installed and removed between the FPU and a subsea structure, such as a Christmas tree, using an installation vessel. The riser is generally pre-constructed and mounted on a reel on the installation vessel. The riser is then lowered into the sea from the installation vessel. As also described above, FPUs may have the ability to move laterally while remaining connected to the subsea wells via flexible risers to maintain production. This ability to move is necessary to allow new wells to be drilled from an FPU, or existing wells to be maintained, while maintaining hydrocarbon production. The approach presented here exploits the FPU's ability to move to remove the necessity for the installation vessel to enter an exclusion zone surrounding the riser balcony of the FPU during the operations of removing and installing a riser or other flexible line. As such, safety levels can be maintained and without the need to interrupt ongoing production.

Figure 7:
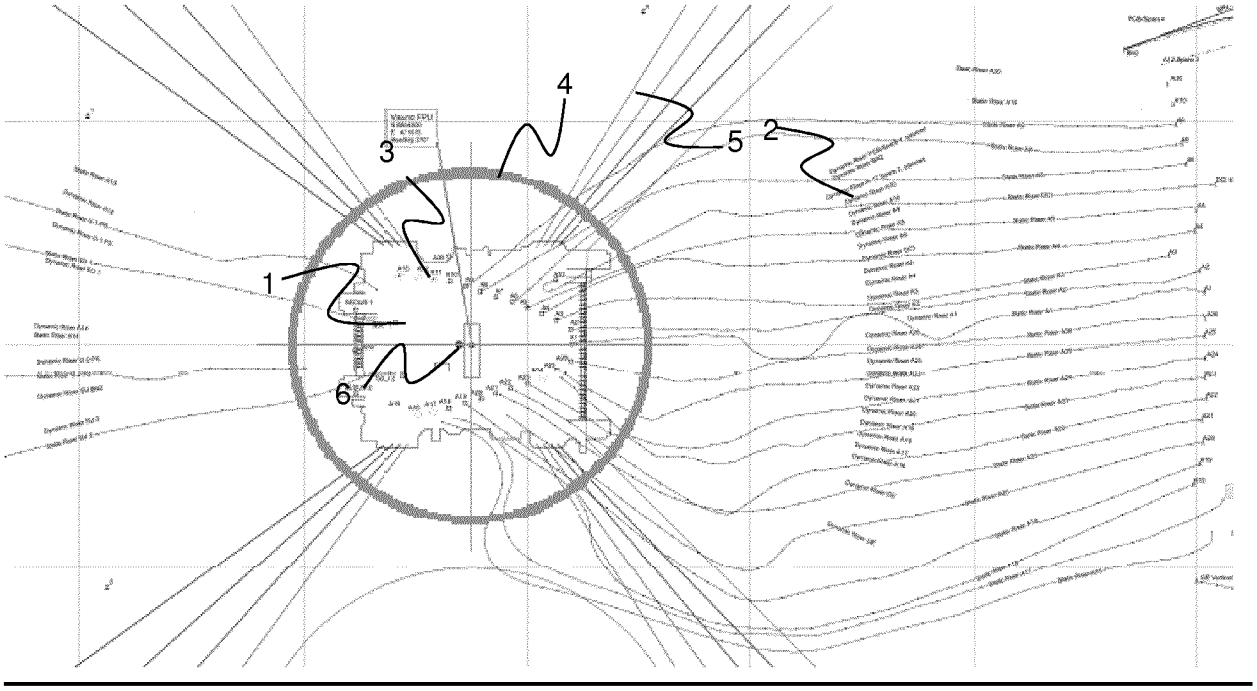
FIG. 7 illustrates schematically the area within which an FPU that is adapted to drill new wells while maintaining hydrocarbon production can move.

FIG. 7 illustrates the area within which an FPU can move while maintaining hydrocarbon production. The FPU 1, which is shown in a central position, is secured to the seabed by cables or mooring lines 5. The Figure illustrates a set of twenty four wells 3 located generally beneath the platform and arranged in a V-shaped pattern. The subsea wells 3 each comprise a subsea structure, e.g. Christmas tree, to which risers 2 are connected. In FIG. 7 the centre 6 of the FPU 1 is located substantially above subsea wells 3, and risers 2 are connected between the FPU 1 and the subsea structures in a Pliant Wave configuration. In FIG. 7 only the portions of the risers 2 that lie along the seabed and return back from subsea anchor points to the subsea structures 3 are shown; the portions of the risers 2 extending from the platform to the subsea anchor points are not shown. The circle 4 shown in the Figures indicates the maximum extent of movement of the centre 6 of the FPU 1. The circle 4 may have a radius of, for example, 80 m. The FPU 1 can be moved by shortening and lengthening the cables 5 as needed, such that the centre 6 of the FPU 1 remains within the area enclosed by the circle 4.

Figure 8:
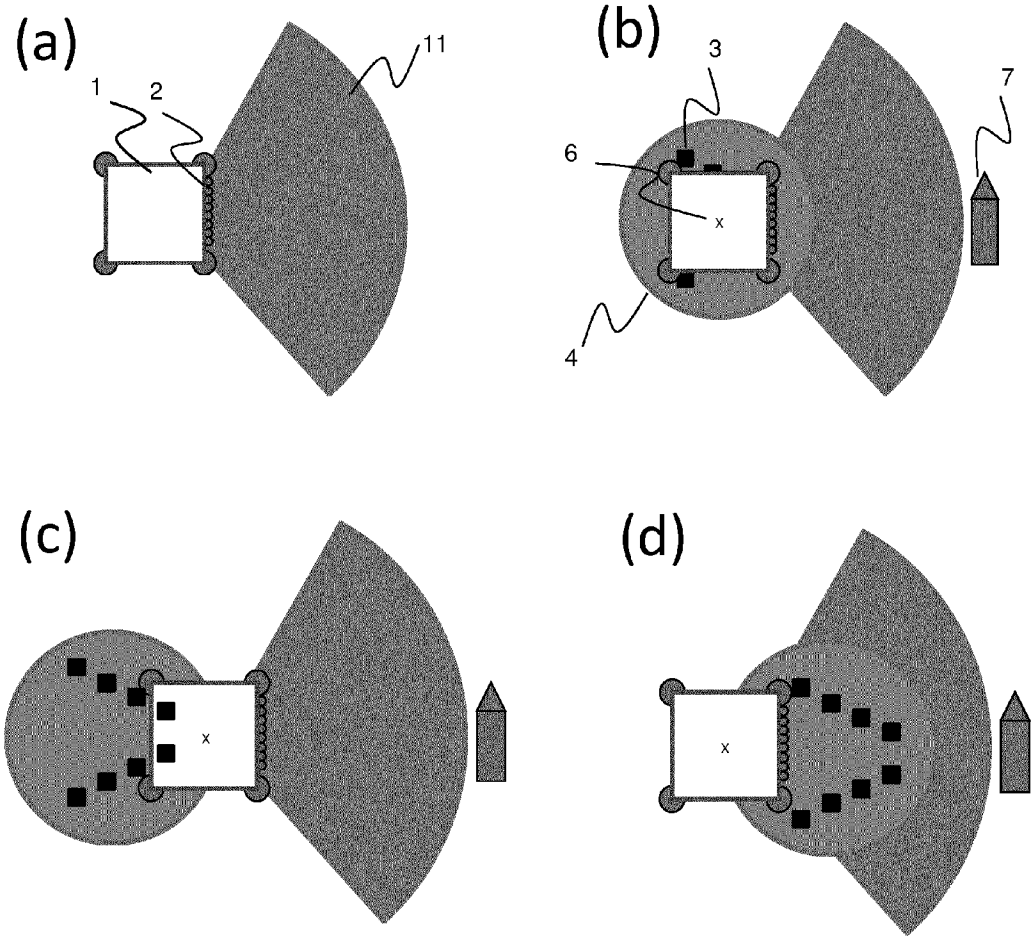
FIG. 8(*a*) to (*d*) illustrates schematically an exclusion zone around the riser balcony of an FPU and the movement of an FPU that may occur during a process of replacing a riser.

FIG. 8(*a*) illustrates an exclusion zone 11 around a riser balcony of an FPU 1, where risers 2 are coupled to the riser balcony of the FPU. If any vessel enters the exclusion zone it may be necessary to depressurise the risers and cease hydrocarbon production. The exclusion zone may be defined by the area enclosed by an arc 200 m from the riser balcony of the FPU 1 and two radii extending at an angle of 30° relative to a straight line defined by the edge of the riser balcony. FIG. 8(*b*) to (*d*) illustrates the movement of an FPU 1 that may occur during a process of replacing a riser, where the FPU is secured to the seabed by cables or mooring lines (cables or mooring lines 5 are omitted in FIG. 8 (*a*) to (*d*) for clarity). In FIG. 8(*b*) the centre 6 of the FPU 1 is located substantially above subsea wells 3; the risers 2 may be connected between the FPU 1 and the subsea structures in a Pliant Wave configuration. An installation vessel 7 is shown outside of the exclusion zone 11. As in FIG. 7, the circle 4 shown in the Figures indicates the maximum extent of movement of the centre 6 of the FPU 1. As stated above, the FPU 1 can be moved by shortening and lengthening the cables 5 as needed. For example, in FIG. 8(*c*) the two right-hand sets of cables have been shortened and the two left-hand sets of cables have been lengthened, relative to FIG. 8(*b*). In FIG. 8(*c*) the FPU 1 has moved as far as possible to the right. The installation vessel 7 has also moved to the right, to remain outside of the exclusion zone 11. In FIG. 8(*d*) the FPU 1 has moved as far as possible to the left, and the installation vessel 7 has moved to a position as close as possible to the subsea wells 3 while remaining outside the exclusion zone 11 and off the riser balcony of the FPU 1. As will be described below, this movement facilitates the replacement of a riser without the need for an installation vessel 7 to enter the exclusion zone 11. As shown in FIG. 8(*d*), it may be possible for the FPU to move to a position where the centre 6 of the FPU 1, or the FPU 1, is not located above the subsea wells 3.

A procedure for removing an installed flexible riser will now be described with reference to FIGS. 9 to 13.

Figure 9:
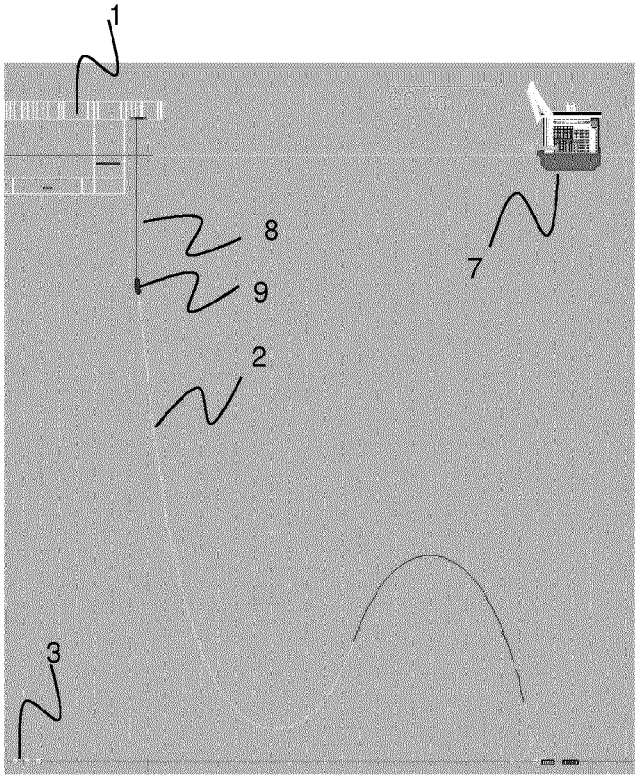
FIGS. 9 to 13 illustrate schematically a procedure for removing a flexible riser deployed between an FPU and a subsea structure.
Figure 10:
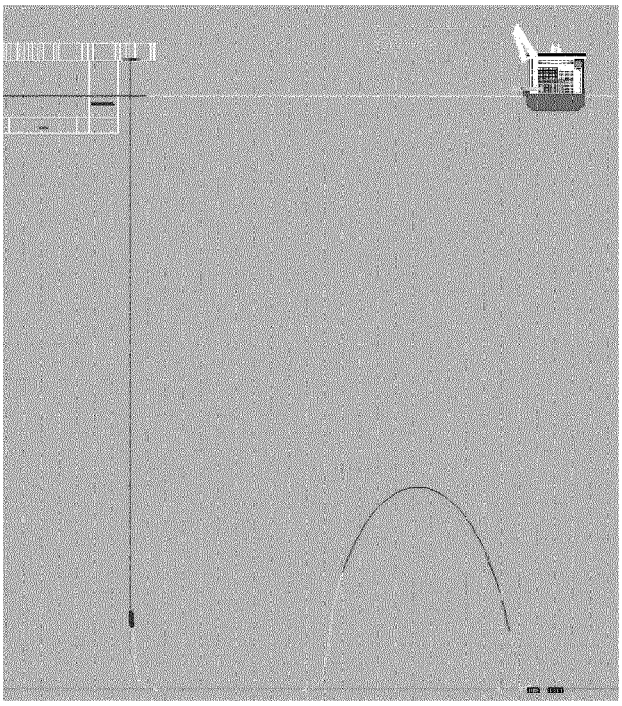
Figure 11:
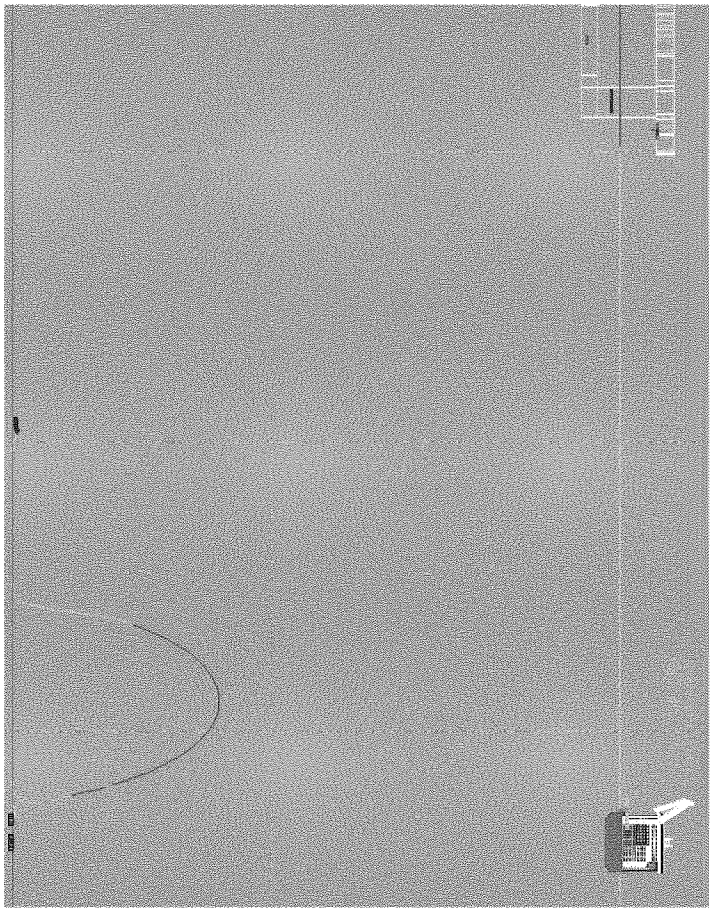

FIG. 9 illustrates an installation vessel 7 located outside of an exclusion zone adjacent to an FPU 1. The FPU has been moved as far as possible to the right, e.g. 80 meters to the right of its centre location. As shown in FIG. 9, a topside end 9 of a flexible riser 2, which in the example shown in FIG. 9 had connected the FPU 1 to a subsea structure 3 in a Pliant Wave configuration (other riser configurations may be used), has been decoupled from the riser balcony of the FPU 1 and partially lowered from the FPU 1 using a pull-in wire (PIW) 8. FIG. 10 illustrates the topside end 9 of the riser 2 lowered still further such that the riser is laid along the seabed. FIG. 11 illustrates the situation after the topside end has been landed on the seabed, and the PIW has been released and pulled back up to the platform. The PIW 8 may be disconnected from the topside end 9 of the riser 2 using a Remotely Operated Vehicle (ROV).

Figure 12:
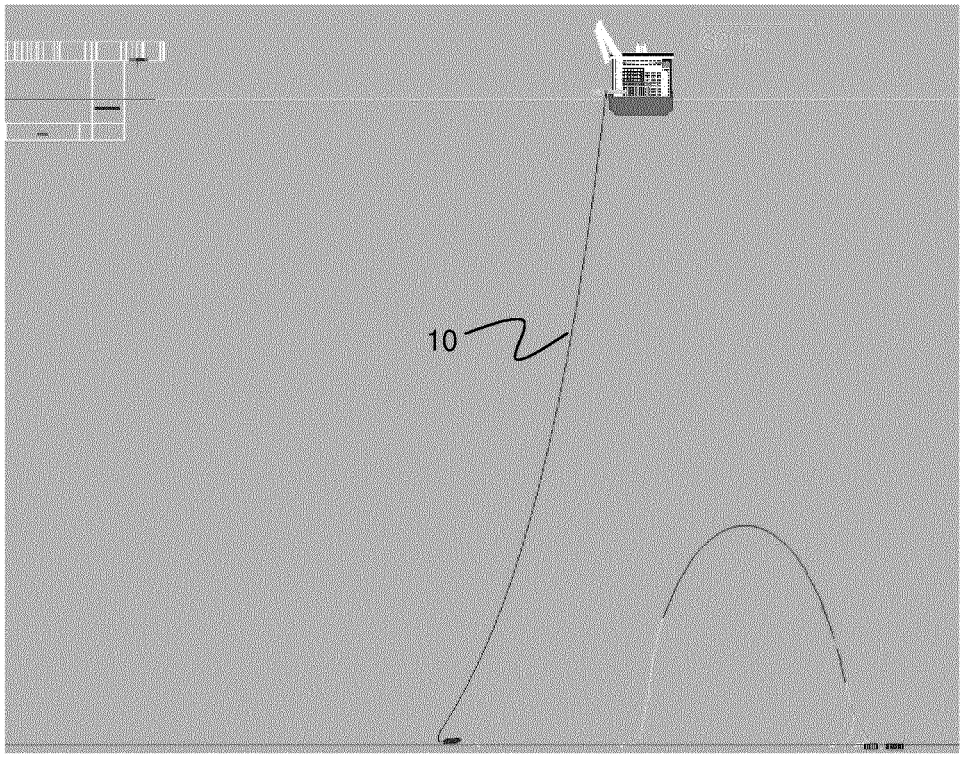
Figure 13:
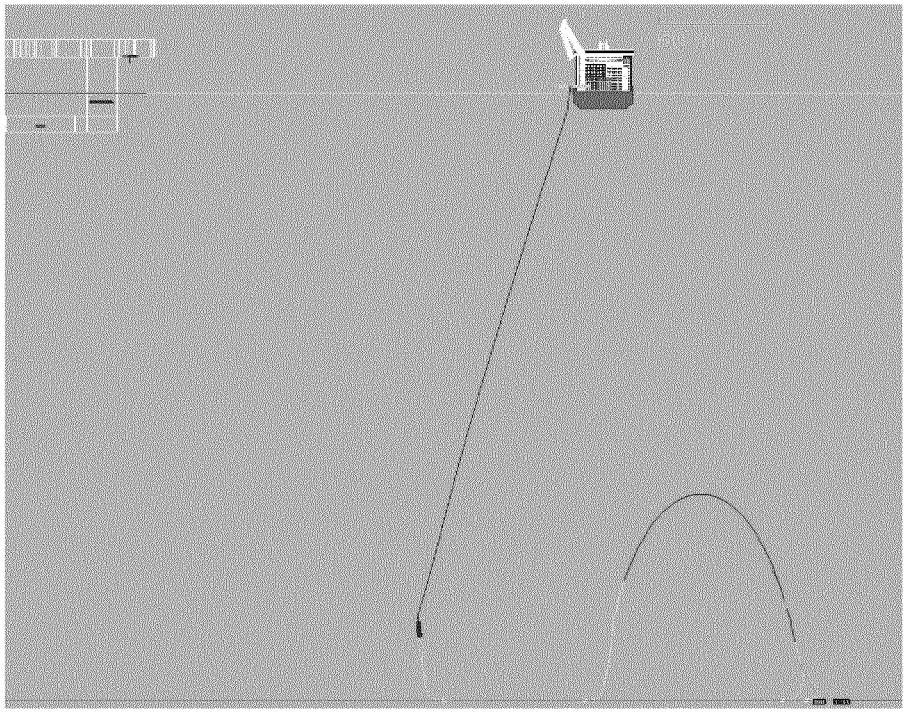

In FIG. 11 the FPU 1 is shown moved as far as possible to the left, away from its central position and from the installation vessel 7. The FPU has therefore moved 160 meters to the left of its previous position, and therefore approximately 160 meters from the topside end of the riser. At this stage, the installation vessel can move to the left without entering the exclusion zone around the riser balcony, as shown in FIG. 12. Indeed, as the FPU has moved 160 meters to the left of the topside end of the riser, the installation vessel can move to a position that is within 40 meters of the topside end, assuming an exclusion zone of 200 from the riser balcony, close enough for a line, for example an abandon and recovery wire 10, to be lowered from the installation vessel 7 and connected to the topside end 9, as illustrated in FIG. 13. It should be noted that, typically, the abandon and recovery wire 10 is deployed from a crane located on the installation vessel. This crane may have an arm that extends 10 to 15 meters out from the installation vessel, and the crane may extend into the exclusion zone; this means that the lateral distance between the point on the installation vessel from which the abandon and recovery wire depends and the topside end of the riser may be reduced to 25 to 30 meters. The connection between the abandon and recovery wire 10 and the topside end 9 may be performed using an ROV. NB. If the installation vessel is much further away from the topside end, even though an ROV could be used to connect the abandon and recovery wire to the topside end of the riser, it would probably not be possible to lift the riser.

In FIG. 13 the topside end 9 of the riser 2 is shown being winched up to the installation vessel 7. The subsea end of the riser is subsequently disconnected from the subsea structure, e.g. using an ROV, and the clump weight and anchor also removed using an ROV, such that the entire length of the riser can be winched up to the installation vessel where it is wound up on a spool. During this process, the installation vessel may move slowly to the right. At the end of this process, the installation vessel is moved out of the vicinity of the FPU, allowing the FPU to return to its central or other desired operating position (FIG. 8(*b*)). To facilitate removal of the riser the disconnected subsea end may be mounted on a trolley, sledge, or similar apparatus.

Using this method the removal of a riser from an FPU can be performed without the need to stop hydrocarbon production, and without compromising safety.

FIGS. 9 to 13 describe a riser removal procedure in which the topside end of the riser is raised onto the installation vessel first. However, an alternative procedure is possible in which the subsea end of the riser is raised first onto the installation vessel. In this case, the procedure employs the steps illustrated in FIGS. 9 to 11 to disconnect and lower the topside end of the riser to the seabed, and to position the FPU and the installation vessel in their left most positions (only the FPU is shown in its leftmost position in FIG. 11). At this point however, the abandon and recovery wire 10 is lowered from the installation vessel 7 and connected to the (disconnected) subsea end.

It will be appreciated that a procedure for installing a riser will follow the reverse procedure to that described with reference to FIGS. 9 to 13, as illustrated in FIGS. 14 to 17. In a first step, the FPU moves away from an installation vessel (i.e. 80 meters to the left of its central position) to allow the installation vessel to approach as close as possible to a position above the subsea wells while remaining outside of the exclusion zone around the riser balcony. The subsea end of the riser is lowered from the installation vessel to the seabed or to an intermediate position between the installation vessel and the seabed. The subsea end of the riser is transported to a subsea structure on a subsea well and is then connected to the subsea structure. The subsea end of the riser may be transported to the subsea structure using an ROV or a winch wire extending from the platform. The subsea end of the riser may be connected to the subsea structure using an ROV. An intermediate step may comprise the installation of buoyancy aids and/or weights on the riser and the tethering of the riser to achieve, for example, a Pliant Wave shape in the riser.

Figure 14:
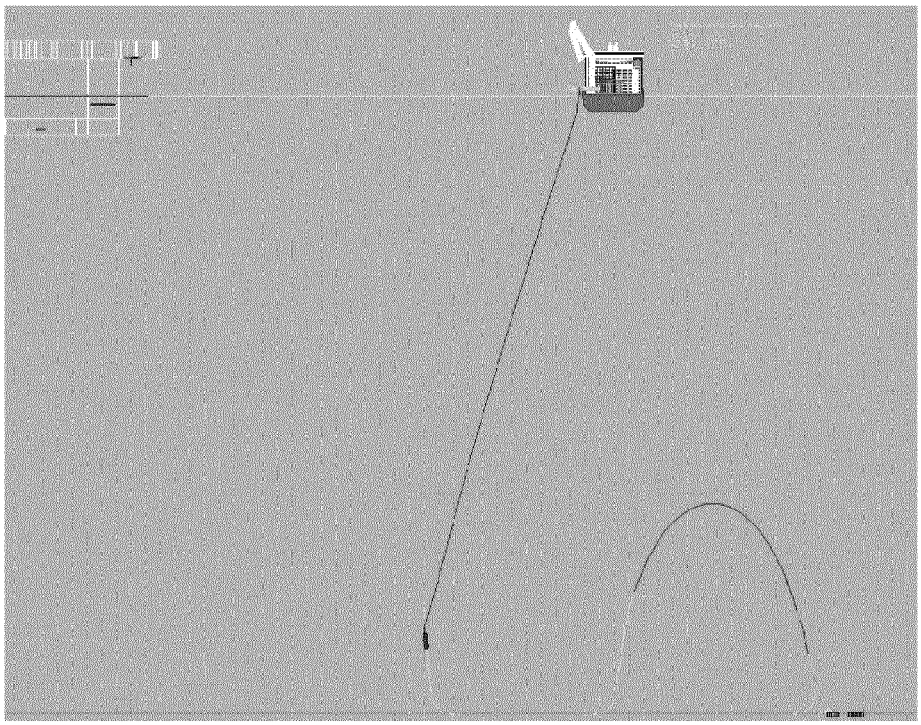
FIGS. 14 to 17 illustrate schematically a procedure for installing a flexible riser between an FPU and a subsea structure.
Figure 15:
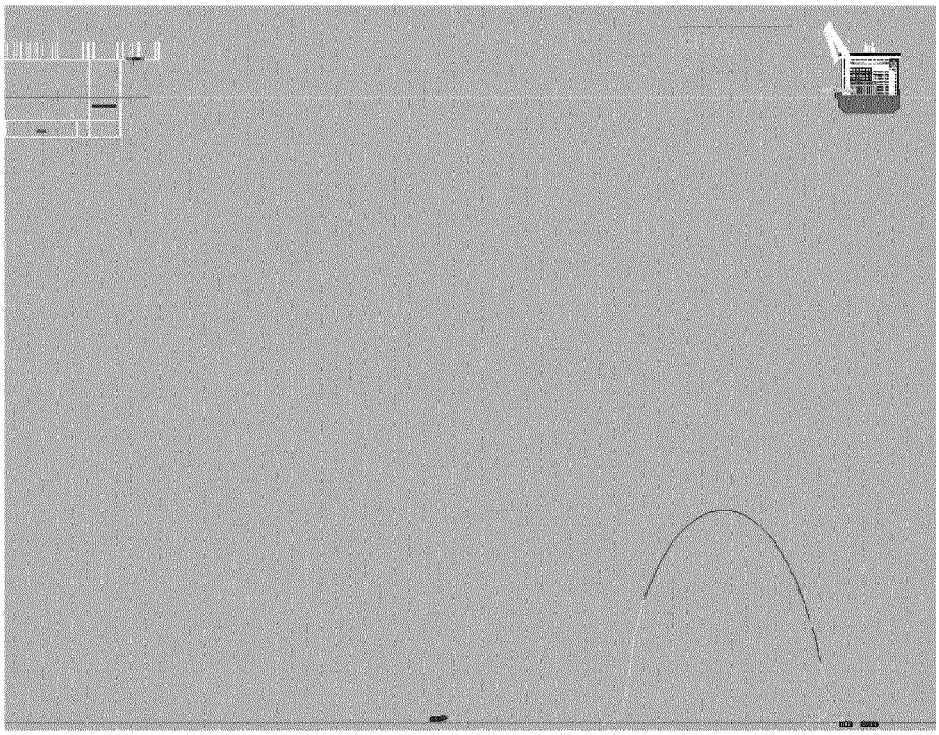
Figure 16:
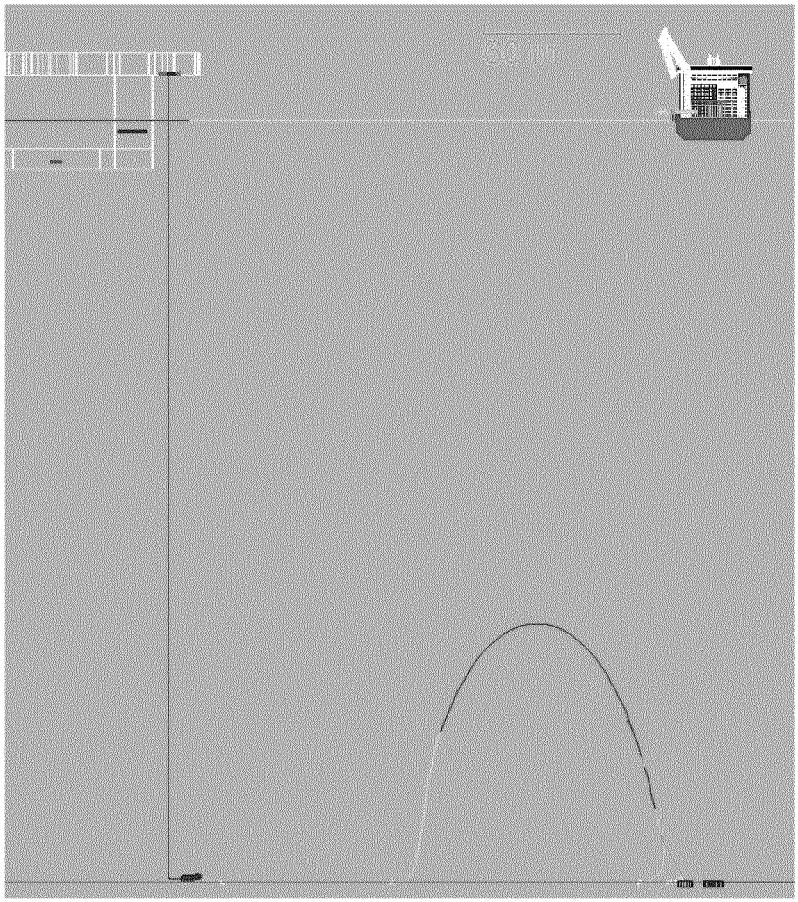
Figure 17:
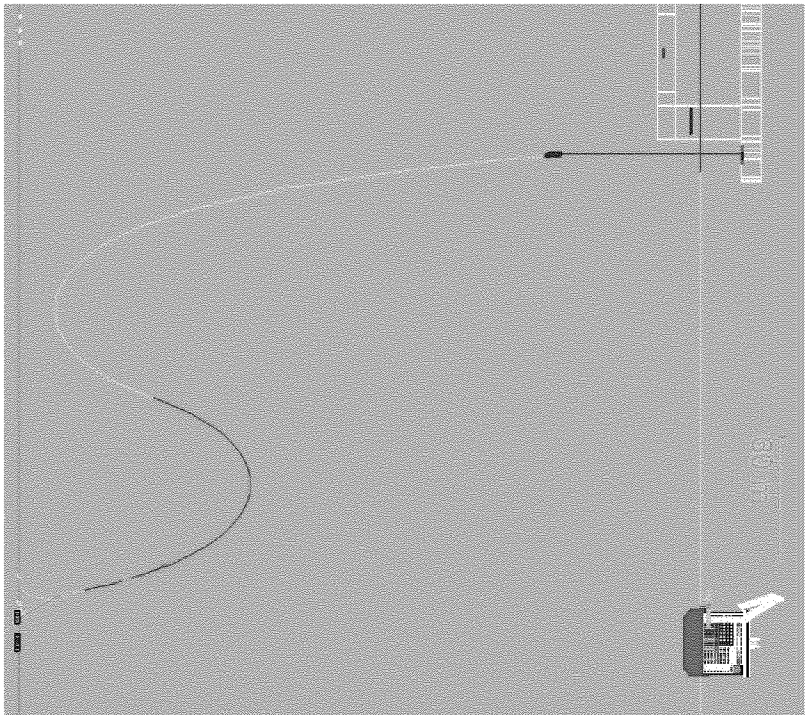

In FIG. 14, the topside end 9 of the riser 2 is shown being lowered to the seabed from the installation vessel 7 using an abandon and recovery wire 10. The abandon and recovery wire may be lowered from a crane arm that extends 10 to 15 meters from the installation vessel. This maximises the reach and therefore minimises the distance between the point at which the topside end of the riser lands on the seabed and the subsea well, while allowing the installation vessel to remain outside the exclusion zone and thus maintain the required safe distance between the installation vessel and the FPU. The abandon and recovery wire 10 is then disconnected. The abandon and recovery wire 10 may be disconnected from the topside end 9 using an ROV. The installation vessel 7 then moves away from the FPU. FIG. 15 shows the situation when the abandon and recover wire 10 has been disconnected and the installation vessel 7 has moved away from the FPU. FIG. 16 shows the situation after the FPU has subsequently returned to its original position and a pull-in wire has been lowered from the FPU and connected to the topside end of the riser. FIG. 17 shows the topside end of the riser being winched up to the FPU. The topside end of the riser is then connected to the riser balcony.

As with the riser removal procedure, the installation procedure (FIGS. 14 to 17) may be reversed such that the topside end of the riser is deployed into the water first, and is pulled into the exclusion zone and connected to the riser balcony. The subsea end is then deployed using the manoeuvres described above.

The approaches presented here provide a reversible method for the removal and installation of a flexible element comprising a riser or other flexible line (such as a power line, umbilical or tube) between an offshore platform and a subsea structure. By exploiting the ability of an FPU to move, the approach may avoid the need for the installation vessel to enter a defined exclusion zone in the vicinity of the platform during the removal or installation process and therefore may avoid the need to shut down platform operations, such as hydrocarbon production.

Figure 18:
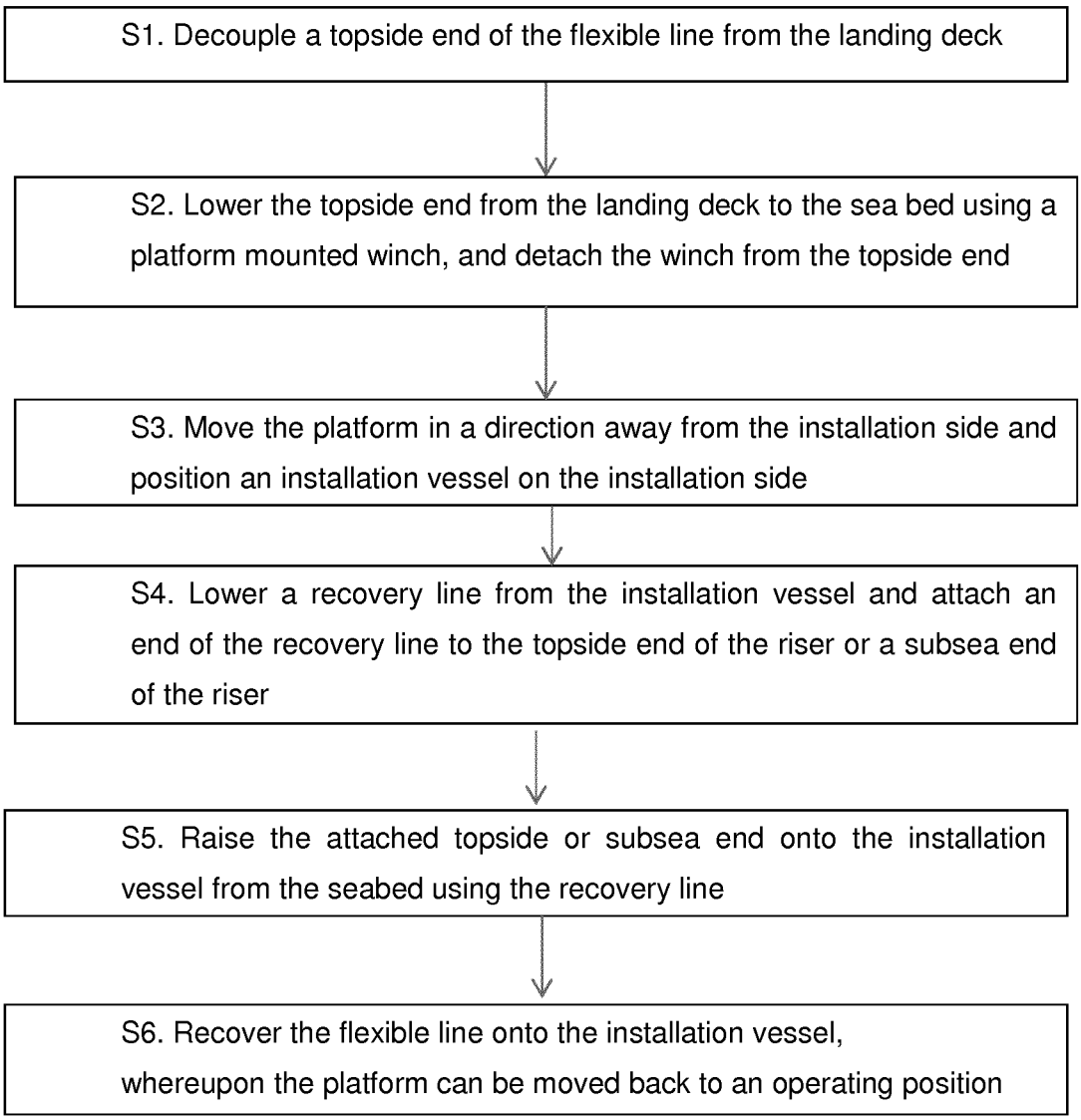
FIG. 18 is a flow diagram further illustrating a procedure for removing a flexible riser.

FIG. 18 is a flow diagram illustrating at a high level a method of removing a flexible line deployed between an offshore platform and a subsea structure. The method comprises, at step S1, decoupling a topside end of the flexible line from the landing deck. At step S2 the topside end is lowered from the landing deck to the sea bed using a platform mounted winch, and the winch is detached from the topside end. At step S3 the platform is moved in a direction away from the installation side and an installation vessel is positioned on the installation side. At step S4 a recovery line is lowered from the installation vessel and an end of the recovery line is attached to the topside end of the riser or a subsea end of the riser. At step S5 the attached topside or subsea end is raised onto the installation vessel from the seabed using the recovery line. At step S6 the flexible line is recovered onto the installation vessel, whereupon the platform can be moved back to an operating position.

Figure 19:
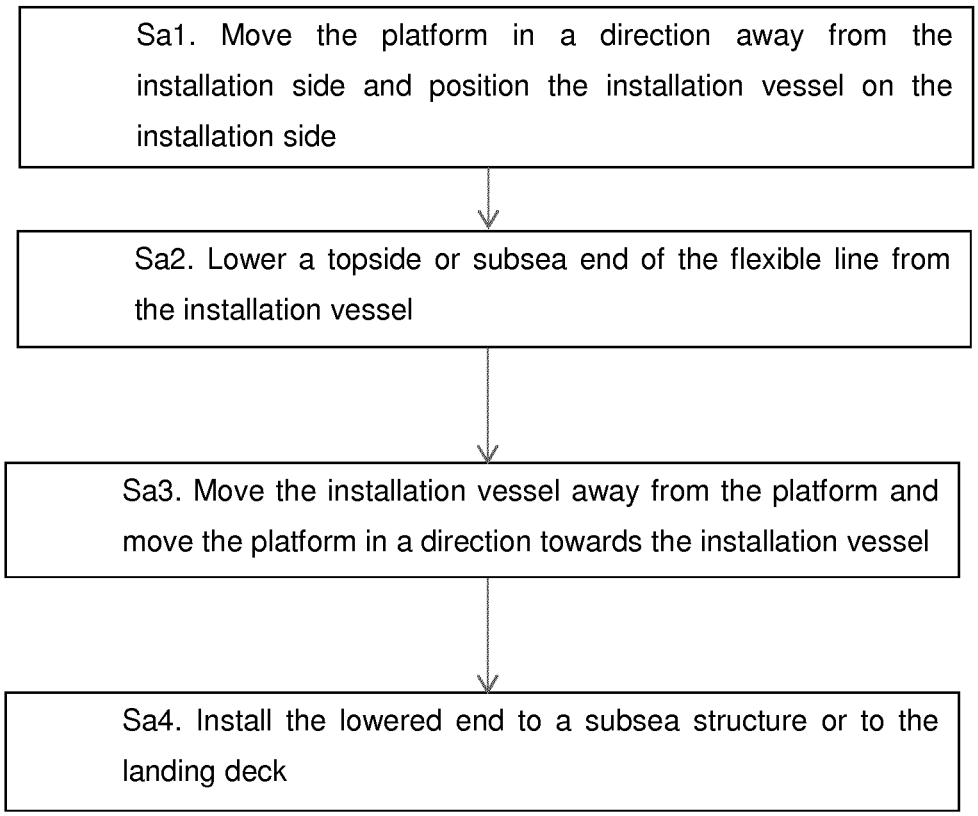
FIG. 19 is a flow diagram further illustrating a procedure for installing a flexible riser.

FIG. 19 is a flow diagram illustrating at a high level a method of installing a flexible line between an offshore platform and a subsea structure. The method comprises, at step Sa1, moving the platform in a direction away from the installation side and positioning the installation vessel on the installation side. At step Sa2 vessel topside or subsea end of the flexible line is lowered from the installation vessel. At step Sa3 the the installation vessel is moved away from the platform and the platform is moved in a direction towards the installation vessel. At step Sa4 the lowered end is installed to a subsea structure or to the landing deck.

It will be appreciated by the person of skill in the art that various modifications may be made to the above described embodiments without departing from the scope of the present invention.

The invention claimed is:

1. A method of removing a flexible line deployed between an offshore platform and a subsea structure, where the platform has a landing deck on which the flexible line is installed, the landing deck facing away from the platform towards an installation side, the method comprising:

decoupling a topside end of the flexible line from the landing deck;

lowering the topside end from the landing deck to the sea bed using a platform mounted winch, and detaching the winch from the topside end;

moving the platform in a direction away from the installation side and away from the topside end and positioning an installation vessel on the installation side by moving the installation vessel towards the subsea structure;

lowering a recovery line from the installation vessel and attaching an end of the recovery line to the topside end of the flexible line or a subsea end of the flexible line;

raising the attached topside or subsea end onto the installation vessel from the seabed using the recovery line; and recovering the flexible line onto the installation vessel, whereupon the platform can be moved back to an operating position located substantially above the subsea structure.

2. The method according to claim 1, further comprising, prior to decoupling the topside end of the flexible line from the landing deck and lowering the topside end from the landing deck, moving the platform in a direction towards the installation vessel.

3. The method according to claim 1, wherein the recovery line on the installation vessel is extended substantially to its maximum extent from the installation vessel towards the platform.

4. The method according to claim 1, further comprising attaching the end of the recovery line to the topside or subsea end of the flexible line using a Remotely Operated Vessel, ROV.

5. The method according to claim 1, further comprising disconnecting the winch from the topside end of the flexible line using an ROV.

6. The method according to claim 1, further comprising, after said step of recovering the flexible line onto the installation vessel, moving the installation vessel in a direction away from the landing deck and relocating the platform to said operating position.

7. The method according to claim 1, wherein the flexible line is a riser for conveying hydrocarbons from a subsea well to an offshore platform, and said landing deck is a riser balcony.

8. The method according to claim 1, wherein the flexible line is deployed between the offshore platform and the subsea structure in a pliant wave configuration.

9. The method according claim 1, wherein an exclusion zone surrounds the landing deck of the offshore platform, and wherein the exclusion zone is defined such that hydrocarbon production must be ceased if a vessel enters the exclusion zone.

10. The method according to claim 1, wherein the platform is moored using mooring lines and said step(s) of moving the platform comprises pulling in and playing out the mooring lines.

11. A method of installing a flexible line between an offshore platform and a subsea structure, where the platform has a landing deck for landing the flexible line, the landing deck facing away from the platform towards an installation side, the method comprising:

moving the platform in a direction away from the installation side and positioning an installation vessel on the installation side towards the subsea structure;

lowering a topside end of the flexible line from the installation vessel;

moving the installation vessel away from the topside end and away from the installation side and moving the platform in a direction towards the topside end; and installing the topside end to the landing deck and installing a subsea end of the flexible line to the subsea structure.

12. The method according to claim 11, further comprising, before lowering the topside end of the flexible line from the installation vessel, lowering the subsea end of the flexible line from the installation vessel using a winch mounted on the installation vessel.

13. The method according to claim 12, further comprising, after lowering the subsea end of the flexible line from the installation vessel, disconnecting the winch line from the subsea end of the flexible line and coupling the subsea end to the subsea structure.

14. The method according to claim 13, further comprising pulling the subsea end of the flexible line to the subsea structure using an ROV or a pull in wire depending from the platform.

15. The method according to claim 13, further comprising pulling the subsea end of the flexible line to the subsea structure using a pull in wire depending from the platform.

16. The method according to claim 13, further comprising disconnecting the winch from the subsea end and coupling the subsea end to the subsea structure using an ROV.

17. The method according to claim 11, further comprising, after moving the platform in a direction away from the installation side and prior to lowering a topside end of the flexible line from the installation vessel, installing buoyancy aids and/or weights on the flexible line and tethering the flexible line to a subsea anchor.

18. The method according to claim 11, further comprising attaching the end of the pull in line to the topside end of the flexible line using an ROV.

19. The method according to claim 11, wherein the flexible line is a riser for conveying hydrocarbons from a subsea well to an offshore platform, and said landing deck is a riser balcony.

20. The method according to claim 11, wherein the flexible line is deployed between the offshore platform and the subsea structure in a pliant wave configuration.

21. The method according to claim 11, wherein an exclusion zone surrounds the landing deck of the offshore platform, and wherein the exclusion zone is defined such that hydrocarbon production must be ceased if a vessel enters the exclusion zone.

22. The method according to claim 11, wherein the platform is moored using mooring lines and said step(s) of moving the platform comprises pulling in and playing out the mooring lines.

* * * * *